US005771515A

United States Patent [19]

Carr

[11] Patent Number: 5,771,515

[45] Date of Patent: Jun. 30, 1998

[54] MATTRESS ELEVATING APPARATUS

[76] Inventor: Aubrey T. Carr, 283 Petersburg Rd., Powhatan, Va. 23139

[21] Appl. No.: 857,294

[22] Filed: May 16, 1997

[51] Int. Cl.[6] ..... A47C 21/06

[52] U.S. Cl. ..... 5/660; 5/925

[58] Field of Search ..... 5/660, 925, 659, 5/900.5, 731, 690

[56] References Cited

U.S. PATENT DOCUMENTS

| | | | |
|---|---|---|---|
| 254,759 | 3/1882 | Young | 5/731 |
| 1,382,531 | 6/1921 | Newborn | 5/900.5 |
| 2,381,509 | 8/1945 | Muenzen . | |
| 2,847,685 | 8/1958 | Freedlander | 5/659 |
| 3,021,533 | 2/1962 | Emery . | |
| 3,259,921 | 7/1966 | Alsobrook, Jr. . | |
| 3,931,653 | 1/1976 | Bien . | |
| 3,952,346 | 4/1976 | Carlson . | |
| 4,193,150 | 3/1980 | Vineberg | 5/900.5 |
| 4,528,706 | 7/1985 | Branker | 5/660 |
| 4,935,978 | 6/1990 | Luchonok et al. | 5/900.5 |
| 5,205,005 | 4/1993 | Merrill et al. . | |

*Primary Examiner*—Alexander Grosz

*Attorney, Agent, or Firm*—J. Michael Martinez de Andino; McGuire, Woods, Battle & Boothe LLP

[57] ABSTRACT

A bed elevating apparatus for use between a mattress and a box spring that is supported by a bed frame or is insertable within the mattress. The bed elevating apparatus is made of foam or rubber and has opposite spaced apart first and second ends. The first end has a first height and the second end has a second height with the first height being greater than the second height. The bed elevating apparatus also has a top surface that extends substantially in a single angularly extending plane with respect to the ground surface. The supported mattress and the mattress having the bed elevating device inserted inside the mattress have spaced apart mattress first and second ends whereby the mattress first end is elevated above the mattress second end in a single angularly extending plane with respect to the ground surface.

4 Claims, 1 Drawing Sheet

MATTRESS ELEVATING APPARATUS

DESCRIPTION

1. Field of the Invention

This invention relates in general to bed elevating devices and, more specifically, to a rubber or foam bed elevating apparatus that is insertable between the box spring and the mattress, whereby the mattress is elevated at a substantially angular extending plane that supports one end of the mattress at a height higher than the opposite end of the mattress.

2. Background Information

Conventional bed elevating devices, such as those described in U.S. Pat. Nos. 2,381,509; 3,021,533 and 3,259,921, have different ways to elevate the head or top portion of a mattress. For example, the 509 patent discloses a device that has a vertically movable head section that has a foldable supporting section mounted on the underside of the movable head section for raising and then lowering the head section, while maintaining the rest of the mattress horizontal. Similarly, the 533 patent discloses a device that is positioned under a mattress and which has supporting legs for raising the head section of the mattress. In contrast, the 921 patent discloses a tilting accessory for a bed that is used to support a mattress and which through the use of a pair of parallel longitudinal rails can raise a supported mattress at an angle. The 921 patent further discloses that the parallel rails are connected to elevating slides that are controlled by a lever which when operated raises the parallel rails and the elevating slides.

The above-mentioned elevating bed devices show the use of a means for elevating the head section only of a mattress or the requirement of a separate set of rails or an operating lever for raising a mattress at an angle. Other elevating bed devices, such as those described in U.S. Pat. Nos. 3,952,346 and 5,205,505, also show the use of a device for elevating only the head portion of a mattress or a device having vertical parallel rails or side frames that are connected together through the use of a set of spaced horizontal slats that support a mattress and which can raise a mattress at an inclined elevation. The 346 patent and the 505 patent elevating mattress devices, however, either only raise the head section of a mattress or require the use of rails and slats for inclining a mattress.

These above-mentioned conventional bed elevating devices encounter several problems such as requiring the use of separate rails, slats, supporting legs or operating levers, or only raise the head portion of a mattress. Moreover, the above-mentioned bed elevating derives do not have a rubber or foam insert that can incline the mattress at a singular angularly extending plane whereby the mattress is elevated at whereby one end of the mattress is higher than the opposite end of the mattress.

In order to overcome the above-mentioned defects in bed elevating devices, there is a need for an improved bed elevating apparatus that is formed from rubber or foam and which can be inserted between the box spring and the mattress for providing for a substantially angular extending plane that supports one end of the mattress at a height higher than the opposite end of the mattress. There is also a need for an improved bed elevating apparatus that provides for a quick and simple way to substantially elevate one end of the mattress at a height higher than the opposite end of the mattress elevate through an single angularly extending plane.

SUMMARY OF THE PRESENT INVENTION

Accordingly, it is the primary object of the present invention to provide a bed elevating apparatus that is formed of rubber or foam and which can be inserted between the mattress and the box spring of a bed for providing a single angularly extending plane for elevating one end of the mattress higher than the opposite end of the mattress.

It is a further object of this invention to provide an improved bed elevating apparatus scarf that can be manufactured with an economic use of materials and labor. Other objects and advantages of this invention will become apparent from the following description taken in connection with the accompanying drawings wherein are set forth, by way of illustration and example, certain embodiments of this invention.

DETAILED DESCRIPTION OF THE PREFERRED EMBODIMENTS OF THE INVENTION

Before the present bed elevating apparatus is described, it is to be understood that this invention is not limited to a particular bed elevating apparatus, as such may, of course, vary. It is also to be understood that the terminology used herein is for the purpose of describing particular embodiments only, and is not intended to be limiting as the scope of the present invention will be limited only by the appended claims.

Figure 1:
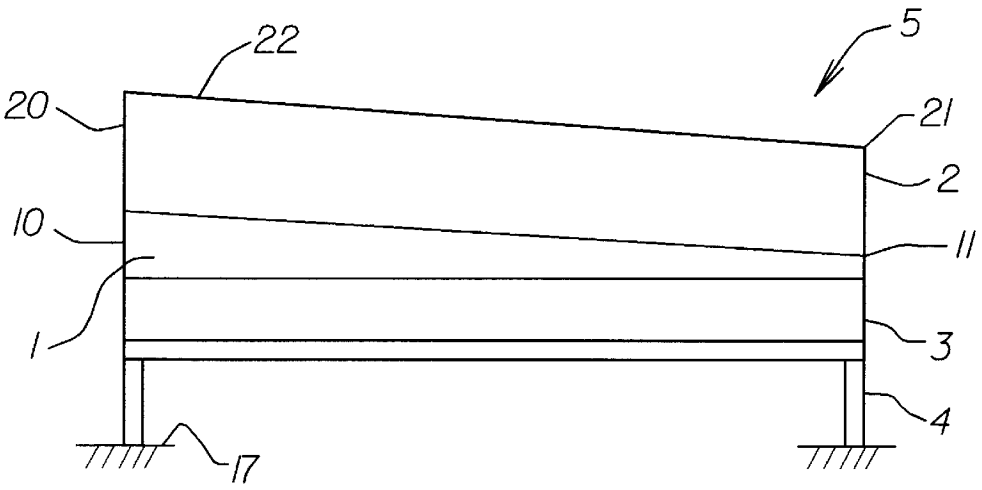
FIG. 1 is an elevational side view of a typical embodiment of a bed elevating apparatus inserted between a box spring and a mattress.

Unless defined otherwise, all terms used herein have the same meaning as commonly understood by one of ordinary skill in the art to which this invention belongs. Referring now to the drawings, a typical embodiment of the bed elevating apparatus is shown in FIG. 1. The bed elevating apparatus is generally designated by the reference numeral 1 and can be made of different types of materials, including but not limited to rubber or foam. The bed elevating apparatus 1 can be made into any size of bed, such as a king, queen, full or twin size.

Figure 2:
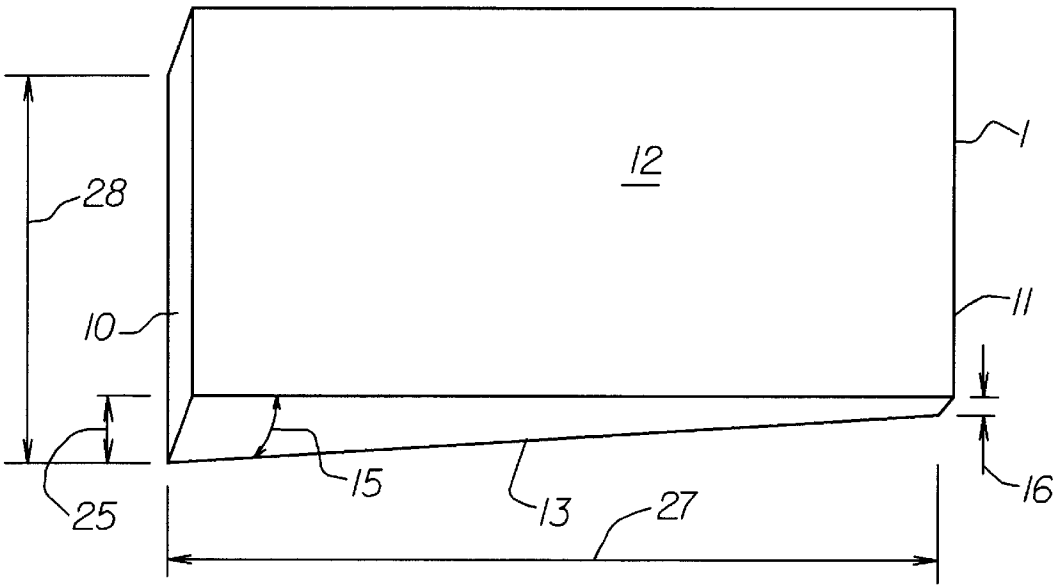
FIG. 2 is a perspective view of the bed elevating apparatus.

As shown in FIG. 1, the bed elevating apparatus 1 is shown inserted in between a mattress 2 and a box spring 3 that are all supported by a bed frame 4. The bed elevating apparatus 1, mattress 2, box spring 3 and the bed frame 4 together form a bed 5. As shown in FIGS. 1 and 2, the bed elevating apparatus 1 has spaced apart first and second ends 10 and 11, respectively, and top and bottom surfaces 12 and 13, respectively. The top surface 12 extends at an angle 15 to the horizontally extending support surface 17. Specifically, the top surface 12 extends at the angle 15 in a substantially single angularly extending plane with respect to the support surface 17 from the first end 10 to the second end 11. The bed elevating apparatus 1 when inserted into the bed 5 raises the mattress first end 20 to a height above the support surface 17 that is higher than the mattress second end 21. The bed elevating apparatus 1 thereby causes the top surface 22 of the mattress 2 to extend at the same angle 15 in a substantially single angularly plane with respect to the support surface 17 from the mattress first end 20 to the mattress second end 21. While not shown, the bed elevating apparatus 1 can also be inserted inside the mattress 2 such that the mattress 2 has its mattress first end 20 raised to a height above the mattress second end 21 as discussed above.

As shown in FIG. 2, the first end 10 of the bed elevating apparatus 1 has a first height 25 and the second end 11 has a second height 26. The first height 25 is larger than the second height 26. In a preferred form, the first height 25 ranges from approximately 4½ inches to 12 inches, while the second height ranges from approximately 1 to 2 inches. Additionally, the bed elevating apparatus 1 has a length 27 that ranges from approximately 6 feet to 6½ feet and a width 28 that ranges from approximately 3 feet to 6½ feet.

The bed elevating apparatus 1 is designed to provide for a means for elevating the mattress first end 20 in a substantially single angularly plane with respect to the support surface 17. The bed elevating apparatus 1 further provides for a stabilized means for elevating the mattress first end 20 that prevents the mattress 2 from slipping off the bed elevating apparatus 1 when the bed elevating apparatus 1 is inserted in between the box spring 3 and the mattress 2. This is because the foam or rubber material that is used to make the bed elevating apparatus 1 is not conducive to such slippage and the range of the first height 25 is not so large as to cause the mattress 2 from slipping from the box spring 3. Additionally, if the bed elevating apparatus 1 is made and inserted inside the mattress 2, the bottom of the mattress is substantially horizontal while the mattress top surface 22 is at a substantially single angularly plane with respect to the support surface 17.

SUMMARY

In operation, the present invention is directed toward a bed elevating apparatus 1 that can be inserted between a mattress 2 and a box spring 3 of a bed 5. Alternatively, the bed elevating device 1 can be placed and made to be inside the mattress 2. The bed elevating apparatus 1 when so used raises the mattress first end 20 to a height above the support surface 17 that is higher than the mattress second end 21. The bed elevating apparatus 1 thereby causes the top surface 22 of the mattress 2 to extend at an angle 15 in a substantially single angularly extending plane with respect to the support surface 17 from the first end 10 to the second end 11.

It is to be understood that while certain forms of this invention have been illustrated and described, the invention is not limited thereto, except insofar as such limitations are included in the following claims.

What is claimed and described to be secured by Letters Patent is as follows:

1. A bed accessory removably inserted between a mattress and a box spring, the box spring being supported on a substantially horizontal support surface, the bed accessory having opposite spaced apart first and second ends, opposite spaced apart parallel sides, and top and bottom surfaces, the first end having a first height extending between the top and bottom surfaces and the second end having a second height extending between the top and bottom surfaces with the first height being greater than the second height, the top surface extending substantially in a single angularly extending plane with respect to the support surface, the mattress having opposite spaced apart mattress first and second ends, the mattress being supported by the top surface of the bed accessory at an angle with respect to the support surface whereby the mattress first end is elevated above the mattress second end, the bed accessory having a stabilized means for preventing the mattress from slipping off the bed accessory.

2. The bed accessory set forth in claim 1 wherein the bed accessory is made from a material that is not conducive to allowing the mattress from slipping off the bed accessory.

3. A bed accessory removably inserted between a mattress and a box spring, the box spring being supported on a substantially horizontal support surface, the bed accessory having opposite spaced apart first and second ends, opposite spaced apart parallel sides and top and bottom surfaces, the first end having a first height extending between the top and bottom surfaces and the second end having a second height extending between the top and bottom surfaces with the first height being greater than the second height, the top surface extending substantially in a single angularly extending plane with respect to the support surface, the mattress having opposite spaced apart mattress first and second ends and being supported by the top surface of the bed accessory at an angle with respect to the support surface whereby the mattress first end is elevated above the mattress second end, the bed accessory being made from a material not conducive to allowing the mattress from slipping off the bed accessory.

4. The bed accessory of claim 3 wherein the bed accessory has a size that is approximately equal to the size of the mattress.

* * * * *